US005697730A

United States Patent [19]

Goering

[11] Patent Number: 5,697,730

[45] Date of Patent: Dec. 16, 1997

[54] ROADWAY HAVING CONVECTION COOLING FOR PERMAFROST REGIONS

[75] Inventor: Douglas J. Goering, Fairbanks, Ak.

[73] Assignee: University of Alaska, Fairbanks, Ak.

[21] Appl. No.: 505,792

[22] Filed: Jul. 21, 1995

[51] Int. Cl.[6] ..... E01C 3/00

[52] U.S. Cl. ..... 404/27; 404/71; 404/82

[58] Field of Search ..... 404/17, 27, 28, 404/71, 72, 75, 82, 31

[56] References Cited

U.S. PATENT DOCUMENTS

| | | | |
|---|---|---|---|
| 1,747,125 | 2/1930 | Murphy | 404/27 X |
| 3,250,188 | 5/1966 | Leonards | 404/31 |
| 3,279,334 | 10/1966 | Quartararo . | |
| 3,722,378 | 3/1973 | Best | 404/31 |
| 3,732,791 | 5/1973 | Hohwiller et al. | 404/31 |
| 3,839,518 | 10/1974 | Rubens et al. | 404/27 X |
| 3,903,706 | 9/1975 | Gzemski | 404/31 X |
| 3,909,143 | 9/1975 | Cushman | 404/27 |
| 3,910,710 | 10/1975 | Gagle et al. | 404/31 X |
| 3,986,783 | 10/1976 | Condo et al. | 404/31 |
| 4,181,448 | 1/1980 | Crosky | 404/27 |
| 4,909,662 | 3/1990 | Baker | 404/28 X |
| 5,007,764 | 4/1991 | Pontynen | 404/28 X |

FOREIGN PATENT DOCUMENTS

| | | | |
|---|---|---|---|
| 988726 | 5/1976 | Canada . | |
| 1005999 | 8/1977 | Canada . | |
| 1061031 | 8/1979 | Canada . | |
| 2051024 | 3/1993 | Canada . | |
| 260101 | 10/1989 | Japan | 404/31 |

*Primary Examiner*—James Lisehora

*Attorney, Agent, or Firm*—Needle & Rosenberg, P.C.

[57] ABSTRACT

A roadway for use on permafrost terrain is described together with methods of construction, the roadway generally including a porous embankment and a pavement structure disposed on the top of the embankment. The embankment has a desired vertical separation between the bottom and the top of the embankment and comprises material of sufficient permeability to allow buoyancy-driven pore air convection to occur within the embankment when an unstable density stratification exists therein. This unstable density stratification occurs in the winter months when a temperature differential between the top of the embankment and the ground adjacent the bottom of the embankment exists, whereby the roadway promotes natural convection within the porous embankment which enhances heat removal from the embankment and underlying ground to preserve the permafrost layer throughout the year.

17 Claims, 1 Drawing Sheet

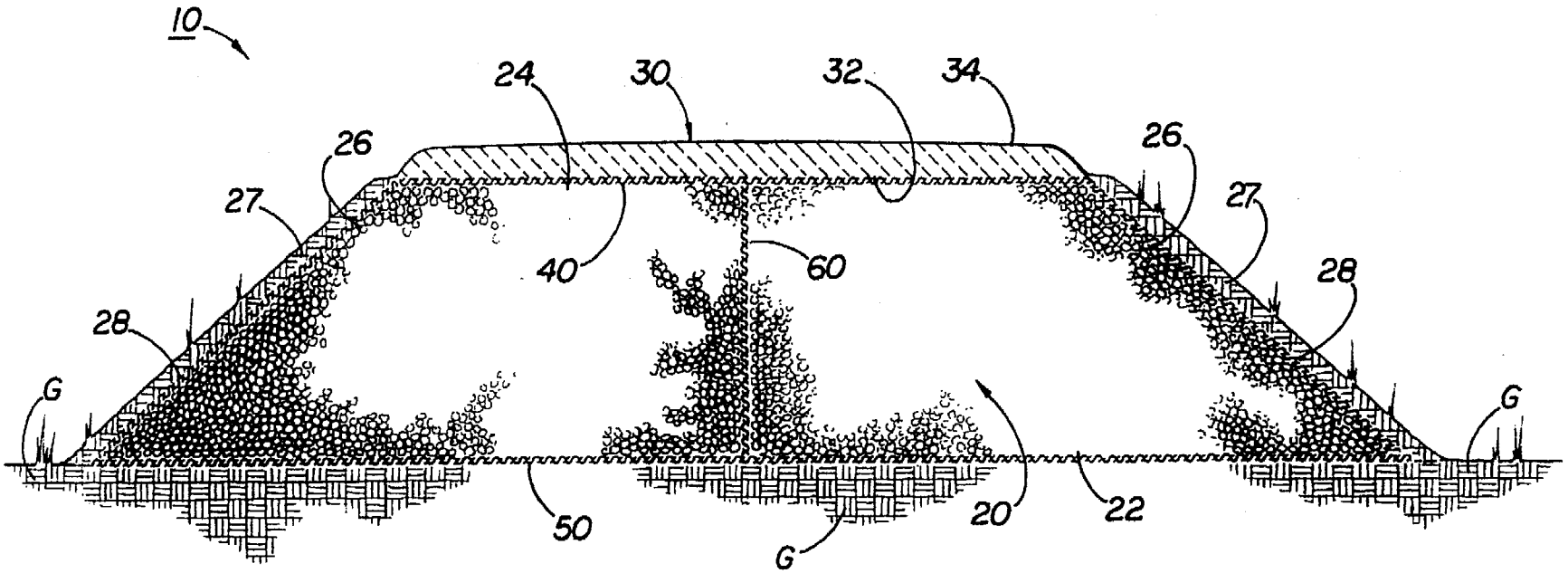
10
24
26
27
28
30
32
34
40
60
26
27
28
G
G
20
22
50

ROADWAY HAVING CONVECTION COOLING FOR PERMAFROST REGIONS

BACKGROUND OF THE INVENTION

1. Field of the Invention

The present invention relates to a road construction, particularly for use in a region having a permafrost layer in the ground. More specifically, the present invention relates to a roadway which allows natural convection of the pore air in the porous embankment to occur during winter to remove heat from the ground under the roadway, thus preserving the permafrost layer throughout the year.

2. Background Art

In northern regions designers are often forced to locate roadway, railway, or airport embankments in areas that are underlain by permafrost. Permafrost in sub-Arctic regions tends to be warm (i.e., near 0° C.) and therefore susceptible to thaw. Often the permafrost layer contains inclusions of thick ice lenses or ice wedges making consolidation likely if thawing occurs. Beneath engineering structures, such as roadway embankments or buildings, thaw consolidation typically results in instability and failure of the structure.

Roadway embankments constructed in permafrost regions usually have a large influence on the thermal regime of the ground. This occurs primarily because the embankment modifies the pre-existing surface conditions and the associated ground-surface energy balance. The ground-surface energy balance is a complex function of seasonal snow cover, vegetation, atmospheric radiation, surface moisture content, and atmospheric air temperature. These factors produce a mean annual surface temperature (MAST) which may differ by several degrees from the mean annual air temperature (MAAT). At undisturbed sites the MAST is typically warmer than the MAAT because of the large impact of the insulating snow layer during winter months. Disturbance of the ground surface due to construction of a roadway embankment often increases the difference between MAST and MAAT, resulting in a warmer surface condition. This often results in thawing of the permafrost, causing settlement of the roadway embankment.

The lack of effective methods for preventing or mitigating thaw settlement has left many northern communities with large maintenance bills and sub-standard roadways. Consequently, techniques for avoiding damage to roadway embankments in permafrost regions have great importance.

Research in the prior art has produced in a number of techniques to protect embankments from thaw settlement. In general, these techniques can be grouped into three categories: (1) those that modify conditions at the embankment surface in an effort to reduce the MAST; (2) those that augment the removal of heat from the embankment structure during winter months; and (3) those that employ insulation within or beneath the embankment. Surface modifications that have been studied include painting the asphalt surface to increase the albedo and the use of snow sheds and snow removal on embankment side slopes. Other attempted solutions include the operation of an experimental air duct system, use of thermosyphons in roadway embankments, use of foam insulation in roadway and airfield embankments, and use of insulating materials in order to reduce embankment fill requirements in Arctic regions. Each of these techniques has suffered from some combination of limited effectiveness, high cost, high maintenance, or safety concerns when applied in the field. As a result, these methods have been employed only on an extremely limited or research basis. Accordingly, the vast majority of roadways constructed in sub-Arctic environments still lack protection from damage or complete failure due to thaw settlement.

A number of the techniques described above have been the subject of previous Canadian and U.S. patents. The closest known prior art is Canadian patent 2,051,024 granted to Laurel E. Goodrich Mar. 11, 1993. This prior art patent pertains to trafficked surfaces located in permafrost regions and discusses the problems associated with road construction in such areas. In particular it discusses the fact that, in most cases, mere provision of an insulating layer within the embankment is not sufficient to protect the permafrost foundation and roadway from thaw settlement. This prior art patent describes the use of a variable heat conductivity layer within the embankment, the intention of which is to lower the mean annual temperature of the permafrost foundation. The variable conductivity layer is described as being achieved by the inclusion of a variable heat conductivity (K) layer between the permafrost and the trafficked surface. The patent further specifies that the variable K layer is more conductive of heat in the winter than in the summer. The patent discloses that the variable K layer has seasonally variable moisture content; dryer in the summer, and hence having lower K, and more moist in the winter thereby providing higher K due to its frozen water content. The basis of this patent is that the high K in the winter lowers the permafrost temperature because of the better heat conduction between the permafrost and the cold atmosphere. It teaches that in many specific situations the annual mean temperature of the permafrost layer may be lowered from year to year as a result until it reaches a new equilibrium value.

The patent then goes on to describe how the variable K layer is to be constructed, consisting generally of a layer of material in which the moisture content is altered on an annual basis. Such alteration of the moisture content changes the heat conductivity of the layer thus providing a larger thermal conductivity in winter than in summer.

The present invention improves on the prior art in at least two specific ways. First, the present invention does not rely on the ability to change material characteristics (such as moisture content) throughout the course of the annual cycle. This avoids the complexity of intricate layer geometries, heat sinks, impermeable membranes, and the ability to introduce and drain moisture, as described in the Goodrich patent. Secondly, since the present invention relies on natural convection, rather than variable heat conductivity to increase the winter-time heat transfer out of the embankment, it is generally much more effective at reducing the mean annual temperature of underlying permafrost. This is a consequence of the fact that thermal convection can be a much more effective heat transfer process than thermal conduction. It is well known that thermal convection in a cavity of porous material can increase the heat transfer by more than an order of magnitude over that due to thermal conduction alone.

SUMMARY OF THE INVENTION

In accordance with the present invention a roadway is constructed having an embankment containing a highly porous material and a pavement structure placed on the top of the embankment. The high permeability of the material comprising the embankment allows natural convection of the pore air to occur within the embankment during winter months when unstable air density gradients exist therein. This convection removes heat from the embankment and underlying ground during the colder, winter months. During summer, density gradients in the embankment are stable and no circulation occurs. Thus, the embankment works analogous to a one-way heat transfer device, or thermal diode, which removes heat effectively from the embankment and underlying ground during winter without re-injecting heat during the subsequent summer. This increased cooling during the winter prevents thaw of underlying permafrost in the summer, thus eliminating thaw settlement. Analysis shows that winter-time convection in the present invention can lower foundation ground temperatures beneath such embankments by as much as 6° C. on an annual average basis compared to standard sand and gravel embankments.

To ensure sufficient buoyancy-driven pore air convection occurs within the embankment, the material of the embankment must have both sufficient permeability and an adequate vertical separation between the bottom and the top of the embankment. The permeability of the embankment is controlled primarily by the particle size and porosity. To achieve enhanced cooling it is necessary that this material have an intrinsic permeability of 100,000 Darcy (approximately $1\times10^{-3}$ cm$^2$ or $1\times10^{-6}$ ft$^2$) or greater. These permeability requirements can be met by using poorly graded alluvial, gravel, or crushed rock with a low fines content.

The vertical separation between the bottom of the embankment and the top of the embankment should be at least one meter. However, the larger the vertical separation, the better the convection. The minimum height requirement is related to the permeability of the material being used in an inverse relationship. That is, the greater the permeability of the embankment, the less height of the embankment that is required and vice-versa.

The pavement structure, which is placed on the top of the embankment, has no special material requirements. Materials typical of present construction practice, usually consisting of compacted sand/gravel disposed underneath asphalt, can be used. It is possible, however, to pave an asphalt layer directly on the top of the embankment. The thickness of the pavement structure should be minimized. It is desired that the temperature at the lower side of the pavement structure/top of the embankment be approximately as cold as the upper side of the pavement structure which is exposed to low ambient temperatures. If the thickness of the pavement structure is too great, it will begin to reduce the strength and effectiveness of the natural convection occurring within the embankment because of a reduced temperature differential existing between the bottom and top of the embankment.

It is important to substantially prevent entry of fines into the embankment to maintain a high permeability. The roadway, therefore, can optionally have separators positioned intermediate the bottom of the embankment and the ground surface, intermediate the top of the embankment and the pavement structure, or on the sides of the embankment. If fines enter the embankment, they will reduce the permeability and hinder natural convection.

BRIEF DESCRIPTION OF THE DRAWINGS

FIG. 1 is a schematic representation of the component parts of the present invention.

DETAILED DESCRIPTION OF THE INVENTION

The present invention is more particularly described in the following examples which are intended as illustrative only since numerous modifications and variations therein will be apparent to those skilled in the art.

As used in the specification and in the claims, "a" can mean one or more, depending upon the context in which it is used.

Referring to FIG. 1, a roadway 10 of the present invention is shown. This roadway 10 is designed to minimize thawing of permafrost ground thereunder. The embodiment of the roadway 10 illustrated in FIG. 1 can be used, for example, as a driving surface for automobiles. Other configurations can be used and are specifically contemplated in the definition of "roadway." Another use is an airport embankment which would have a much larger width compared to its height. Likewise, the roadway 10 can be used to support railroad tracks for trains.

The roadway 10 comprises a porous embankment 20 having a bottom 22 adjacent the ground G, an opposite top 24, and two sides 26 and a pavement structure 30 having a lower side 32 adjacent the top 24 of the embankment 20 and an opposite upper side 34. The embankment 20 has a desired vertical separation between the bottom 22 and the top 24 of the embankment 20 and comprises material of sufficient permeability to allow buoyancy-driven pore air convection to occur within the embankment 20 when an unstable density stratification exists therein due to a temperature differential between the ground G and the top 24 of the embankment 20. Thus, the roadway 10 promotes natural convection within the porous embankment 20 which enhances heat removal from the embankment 20 and underlying ground G to preserve the permafrost layer throughout the year.

More specifically, low ambient temperatures act on the upper side 34 of the pavement structure 30 during winter months. Similar low temperatures also exist at the lower side 32 of the pavement structure 30/top 24 of the embankment 20 by conduction heat transfer through the pavement structure 30. This temperature difference between the top 24 and bottom 22 of the embankment 20 creates an unstable density stratification. Buoyancy-driven convection of the pore air occurs as a result of the unstable density gradient. The resulting convection enhances the upward transport of heat out of the roadway 10 during winter months, thus cooling the lower portions of the embankment 20 and underlying foundation ground G. During summer months the density stratification is stable and little, if any, convection occurs. Consequently, summer-time heat transfer is dominated by thermal conduction which transports heat less effectively. The roadway 10, in other words, promotes enhanced winter-time cooling of the embankment 20 and underlying ground G, thus avoiding the thawing of permafrost and associated maintenance costs in the warmer, summer months.

Two main, interrelated factors ensure sufficient buoyancy-driven pore air convection can occur within the embankment 20: (1) using material having sufficient permeability and (2) using a desired vertical separation between the bottom 22 and the top 24 of the embankment 20. The material of the embankment 20, which can also be referred to as the embankment core, lies beneath the pavement structure 30. The permeability of the material used in the embankment 20 is controlled primarily by the particle size and porosity. To achieve enhanced cooling, it is necessary that this material have a minimum intrinsic permeability of 100,000 Darcy (approximately $1\times10^{-3}$ cm$^2$ or $1\times10^{-4}$ft$^2$). In general, there is no ideal range for the particle size. But, as a role, it is better to have a larger size of the material and a smaller range, or size distribution. The larger the size of material, the larger the permeability. The more uniform the size of the material, the larger the permeability. If too large a range of particle diameters are used, then the smaller particles will fill the voids between the larger particles, thus reducing the porosity and reducing the permeability.

The material requirements for adequate permeability can be met by poorly graded alluvial or crushed rock with a size distribution that meets the following specifications: substantially all of the material of the embankment 20 has a minimum diameter ($D_{min}$) of at least one centimeter and a maximum diameter ($D_{max}$) of up to five times $D_{min}$ of the material of the embankment 20. More preferably, however, $D_{min}$ is 5 centimeters and the maximum diameter of up to three times $D_{min}$. The cooling effect can be enhanced by increasing $D_{min}$ above five centimeters, but material larger than three times $D_{min}$ should be excluded. These specifications would typically be met by screening to remove material smaller than $D_{min}$ or larger than $D_{max}$.

For the other factor, the vertical separation between the bottom 22 and the top 24 of the embankment 20 should be at least 1 meter. As a rule, the larger the vertical separation, the better the convection. Although there is no maximum height, in practical embankments the height is kept less than the width for material stability reasons. In cases where water is present above the surface of the ground G, the vertical separation should be measured from the water surface rather than from the bottom 22 of the embankment 20. Also, the surface of the ground G may be lower than the level of the ground adjacent to the embankment 20 wherein the vertical separation is still measured between the bottom 22 and the top 24 of the embankment 20.

There is a certain minimum height required to achieve the desired natural convection. The minimum height requirement is related to the permeability of the material being used. This interrelationship is mathematically represented by the Rayleigh number. The Rayleigh number is defined as:

$$Ra = \frac{\rho_o g \beta K H \Delta T}{\mu \alpha}$$

where $\rho_o$ is the density of the pore air, g is acceleration due to gravity, $\beta$ is the thermal expansion coefficient, K is intrinsic permeability, $\Delta T$ is the temperature difference between the upper boundary (the top 24 of the embankment 20) and lower boundary (the surface of the ground G/the bottom 22 of the embankment 20), H is the vertical separation of the embankment 20, $\mu$ is the dynamic viscosity, and $\alpha$ is the thermal diffusivity of the medium. As can be seen, the numerator of the Rayleigh number contains both the height, or vertical separation, of the embankment 20 and the permeability of the material of the embankment.

For Rayleigh numbers less than approximately 40, natural convection is weak and heat transfer in the embankment is dominated by thermal conduction. For Ra larger than this value natural convection becomes important and increases the heat transfer from the lower to the upper boundary over that due to conduction alone. Larger values of Ra result in stronger natural convection and are generally desirable in the present application. In constructing the roadway 10, the variables that can be adjusted in order to increase Ra are the vertical separation of the embankment 20 (H) and the permeability of the embankment 20 (K). It should be realized that the height of the embankment 20 must be increased to allow convection of sufficient strength if the material of the embankment 20 has a lower permeability. Likewise, the height can be lower if there is a higher permeability.

Also of note, Ra increases as the temperature difference increases. Thus, when the upper side 34 of the pavement structure 30 is cleared of snow in the winter, its surface temperature decreases to ambient. This creates a greater temperature differential, $\Delta T$, between the top 24 of the embankment 20 and the ground G. Accordingly, this greater $\Delta T$ increases Ra (and convection), removing more heat from the ground G.

As to the pavement structure 30, it normally consists of the driving surface covering disposed above a supporting layer. There are no special material requirements for the pavement structure 30 and materials typical of present construction practice, usually consisting of compacted sand/gravel disposed underneath asphalt, can be used. It is possible, however, to pave an asphalt layer directly on the top 24 of the embankment 20.

The pavement structure 30 is not part of the embankment 20 and the materials required therefor. However, the vertical separation between the upper side 34 of the pavement structure 30 and the top 24 of the embankment 20 should not exceed 0.5 meters for an asphalt-based pavement structure 30. If the thickness of the pavement structure 30 is too large, there will be a greater temperature difference between the upper side 34 exposed to the low ambient temperatures and the lower side 32. This relatively warmer lower side 32 will reduce the strength and effectiveness of the natural convection occurring within the embankment 20 because of the decrease in the temperature differential between the top 24 and the bottom 22 of the embankment 20 which drives the pore air convection. A thickness of greater than 0.5 meters may be acceptable if the heat transfer effectiveness of the pavement structure 30 is greater than that of asphalt/gravel.

The roadway 10 can further comprise a means, disposed intermediate the top 24 of the embankment 20 and the lower side 32 of the pavement structure 30, for preventing fines from the pavement structure 30 from migrating into the embankment 20. When the pavement structure 30 consists of the asphalt plus some fine sand/gravel material beneath it, the preventing means is needed to keep this fine material from dropping down into the embankment 20 and filling the pores, thus reducing permeability. The preventing means is not necessary if an asphalt layer is placed directly on the top of the embankment 20 without using sand, small rocks, or other similar materials intermediate the top 24 of the embankment 20 and the underside of the driving surface covering.

The preventing means can be any of a variety of separators 40 typically used for the purpose of avoiding material contamination by fines. The separator 40 is disposed on the top 24 of the embankment 20 and stretches horizontally from one side of the embankment 20 to the other. The separator 40 can be thick geofabric sheeting or any other separator which would be strong and capable of stopping fines, such as sand, small rock particles, and the like, from dropping into the embankment 20. It is preferred that the prevention means be a geotextile separator which consists of a geotextile fabric material of sufficient strength and weave tightness to ensure that fine material contained in the pavement structure 30 does not fall or migrate into the material of the embankment 20.

The roadway 10 can further comprise a means for coveting both sides 26 of the embankment 20. The covering means preferably is included in windy areas to prevent intrusion of warm, summer-time air into the embankment 20. The coveting means can be soil 27 and a side separator 28 which is disposed intermediate the soil 27 and the side 26 of the embankment 20. The soil 27 can consist of any combination of free sand and gravel or topsoil. The side separator 28 itself is not required for proper operation of the embankment 20, but should be included if soil 27 or any other slope covering is disposed on the sides 26 of the embankment 20.

The side separator 28, preferably a geotextile separator, prevents migration of fines into the embankment 20. The side separator 28 must be of sufficient strength and weave tightness to ensure that soil 27 contained on the sides 26 of the embankment 20 will not fall or migrate into the embankment 20.

The roadway 10 also can further comprise a means, disposed intermediate the bottom 22 of the embankment 20 and the ground G, for isolating the embankment 20 from the ground G. This prevents migration of fines upward into the embankment 20. The isolating means can be a bottom separator 50, preferably a geotextile separator. This bottom separator 50 requires sufficient strength and weave tightness to ensure that fine material contained in the ground G does not migrate upward into the embankment 20. It is not required for proper operation of the embankment 20, but provides additional assurance that the material in the embankment 20 will not be contaminated with fines.

The ground, G, or foundation layer, normally corresponds to the original ground surface after rearing of vegetation and leveling. In general, the ground G consists of native sands, gravel, or soil overlying permafrost. In some instances, the ground G may consist of backfilled material moved during construction to create a level surface.

In addition, the roadway 10 can further comprise an impermeable separator 60 disposed vertically from the bottom 22 to the top 24 of the embankment 20 and also intermediate the two sides 26 of the embankment 20, preferably along the centerline of the embankment 20. This impermeable separator 60 prevents surface water from flowing laterally through the bottom 22 of the embankment 22. The material used for the impermeable separator 60 can consist of an impermeable high-strength plastic or rubber sheet. The impermeable separator 60 is not required for proper operation of the roadway 10, but is preferably included if the embankment 20 is constructed in areas where surface water is likely to move through the embankment 20. Other impermeable separators 60 can be included in the embankment 20 to shape the convection cells and tailor heat transfer characteristics.

The present invention also encompasses a method of constructing a roadway 10 for use on permafrost ground. The first step is laying an embankment 20 of material having a desired height and sufficient permeability to allow buoyancy-driven pore air convection to occur within the embankment 20 when an unstable density stratification exists therein due to a temperature differential between the ground G and the top of the embankment 20. The next step is installing a pavement structure 30 above the embankment, whereby the roadway 10 promotes natural convection within the porous embankment 20 which enhances heat removal from the embankment 20 and underlying ground G to preserve the permafrost layer throughout the year.

In addition, prior to the step of laying the embankment 20, the method can include the step of positioning a bottom separator 50 on the ground where the embankment 20 is to be located. This bottom separator 50 preferably is a geotextile separator.

Moreover, after the step of laying the embankment 20, the method can encompass the step of covering the sides 26 of the embankment 20 with a side separator 28 and then disposing soil 27 on top of the side separator 28. Furthermore, after the step of laying the embankment 20 and prior to the step of installing the pavement structure, the method can include the step of placing a separator 40 over the top 24 of the embankment 20. And, prior to the step of laying the embankment 20, the method can also include the step of positioning an impermeable separator 60 so that the impermeable separator 60 will be positioned vertically from the bottom 22 to the top 24 of the embankment 20 and intermediate the two sides 26 of the embankment 20.

Although the present process has been described with reference to specific details of certain embodiments thereof, it is not intended that such details should be regarded as limitations upon the scope of the invention except as and to the extent that they are included in the accompanying claims.

What is claimed is:

1. A roadway to minimize thawing on permafrost ground, comprising:

(a) a porous embankment having a bottom adjacent the ground, an opposite top, and two sides, wherein the embankment has a desired vertical separation between the bottom and the top of the embankment and comprises material of a permeability of at least 100,000 Darcy to allow buoyancy-driven pore air convection to occur within the embankment when an unstable density stratification exists therein due to a temperature differential between the ground and the top of the embankment, substantially all of the material of the embankment having a minimum diameter of at least one centimeter and a maximum diameter of up to five times the minimum diameter; and (b) a pavement structure having a lower side above the top of the embankment and an opposite upper side, whereby the roadway promotes natural convection within the porous embankment which enhances heat removal from the embankment and underlying ground to preserve the permafrost layer throughout the year.

2. The roadway of claim 1, wherein the vertical separation between the bottom of the embankment and the top of the embankment is at least 1 meter.

3. The roadway of claim 1, wherein the vertical separation between the upper side of the pavement structure and the top of the embankment does not exceed 0.5 meters.

4. The roadway of claim 1, further comprising means, disposed intermediate the top of the embankment and the lower side of the pavement structure, for preventing fines from the pavement structure from migrating into the embankment.

5. The roadway of claim 4, wherein the prevention means is a geotextile separator.

6. The roadway of claim 1, further comprising means for covering both sides of the embankment.

7. The roadway of claim 6, wherein the covering means is soil and a side separator which is disposed intermediate the soil and the sides of the embankment to prevent migration of fines into the embankment.

8. The roadway of claim 1, further comprising means, disposed intermediate the bottom of the embankment and the ground, for isolating the embankment from the ground, thereby preventing migration of fines upward into the embankment.

9. The roadway of claim 8, wherein the isolating means is a geotextile separator.

10. The roadway of claim 1, further comprising an impermeable separator disposed vertically from the bottom to the top of the embankment and intermediate the two sides of the embankment, thereby preventing surface water flow laterally through the bottom of the embankment.

11. A method of constructing a roadway for use on permafrost ground, comprising the steps of:

(a) laying an embankment of material having a desired height and a permeability of at least 100,000 Darcy to allow buoyancy-driven pore air convection to occur within the embankment when an unstable density stratification exists therein due to a temperature differential between the ground and the top of the embankment, wherein said material has a minimum diameter of at least one centimeter and a maximum diameter of up to five times the minimum diameter; and (b) installing a pavement structure above the embankment, whereby the roadway promotes natural convection within the porous embankment which enhances heat removal from the embankment and underlying ground to preserve the permafrost layer throughout the year.

12. The method of claim 11, wherein the vertical separation between the bottom of the embankment and the top of the embankment is at least 1 meter.

13. The method of claim 11, wherein the vertical separation between the upper and lower surfaces of the pavement structure does not exceed 0.5 meters.

14. The method of claim 11, prior to the laying step, the step of positioning a bottom separator on the ground where the embankment is to be located.

15. The method of claim 11, after the laying step, the step of covering the sides of the embankment with a side separator and then disposing soil on top of the side separator.

16. The method of claim 11, after the laying step and prior to the installing step, the step of placing a barrier over the top of the embankment.

17. The method of claim 11, prior to the laying step, the step of positioning an impermeable separator so that the impermeable separator will be positioned vertically from the bottom to the top of the embankment and intermediate the two sides of the embankment.

* * * * *